US007473163B1

(12) United States Patent
Lee

(10) Patent No.: US 7,473,163 B1
(45) Date of Patent: Jan. 6, 2009

(54) CUTTER GRINDING DEVICE

(76) Inventor: Wang-Sheng Lee, No. 40, Linhai Rd., Chingshuei Chen, Taichung Hsien (TW)

( * ) Notice: Subject to any disclaimer, the term of this patent is extended or adjusted under 35 U.S.C. 154(b) by 0 days.

(21) Appl. No.: 11/867,245

(22) Filed: Oct. 4, 2007

(51) Int. Cl.
*B24B 7/00* (2006.01)
*B24B 9/00* (2006.01)
*B24B 19/00* (2006.01)
*B24B 55/04* (2006.01)

(52) U.S. Cl. ..... 451/233; 451/48; 451/231; 451/375; 451/453

(58) Field of Classification Search ..... 76/102; 408/18; 451/48, 178, 222, 231, 233, 367, 451/371, 375, 376, 451, 453, 457
See application file for complete search history.

(56) References Cited

U.S. PATENT DOCUMENTS 3,126,679 A * 3/1964 Abadjieff ..... 451/375
5,400,546 A * 3/1995 Christian et al. ..... 451/143
5,735,732 A * 4/1998 Bernard ..... 451/242
6,626,745 B1 * 9/2003 Bernard ..... 451/242
6,676,494 B1 * 1/2004 Ching ..... 451/231
6,824,449 B2 * 11/2004 Regna et al. ..... 451/48
7,121,932 B2 * 10/2006 Liao ..... 451/179
7,147,546 B1 * 12/2006 Dovel ..... 451/48
7,172,498 B2 * 2/2007 Bernard et al. ..... 451/231

* cited by examiner

*Primary Examiner*—Timothy V Eley
(74) *Attorney, Agent, or Firm*—Hanley, Flight, & Zimmerman, LLC

(57) ABSTRACT

A cutter grinding device has a housing, a motor, a grinding wheel, a holding cap, multiple cutter holding brackets and a cutter clamping assembly. The holding cap is mounted on the housing, encloses the grinding wheel and has multiple holes formed on corresponding axis coinciding with different portions of the grinding wheel. The brackets are mounted respectively in the inserting holes in the holding cap and each has a working hole aligning with the corresponding hole in the holding cap and at least one pair of holding blocks. The holding blocks on the holding brackets have different heights to hold fins of a milling cutter at different positions and angles when inserted into the brackets. Accordingly, the milling cutter can be ground at different angles with the cutter grinding device conveniently and easily.

12 Claims, 13 Drawing Sheets

CUTTER GRINDING DEVICE

BACKGROUND OF THE INVENTION

1. Field of the Invention

The present invention relates to a cutter grinding device, and more particularly to a grinding device for a milling cutter.

2. Description of Related Art

To sharpen a cutter, such as a milling cutter, a grinding machine with grinding wheels is always used. However, using grinding wheels to sharpen cutters requires an experienced technician with great skill, otherwise the cutter is easily damaged or blunted. Therefore, to sharpen a cutter with a conventional grinding machine is costly, difficult and time-consuming.

To overcome the shortcomings, the present invention tends to provide a cutter grinding device to mitigate or obviate the aforementioned problems.

SUMMARY OF THE INVENTION

The main objective of the invention is to provide a cutter grinding device that is easy and convenient to use for grinding a cutter at different angles.

The cutter grinding device comprises a housing, a motor, a grinding wheel, a holding cap, multiple brackets and a cutter clamping assembly. The housing has a top surface. The motor is mounted in the housing and has a drive shaft protruding out from the top surface of the housing. The grinding wheel is mounted on and driven by the drive shaft and has a grinding disc and a front grinding portion. The grinding disc has a top, a bottom and an edge. The front grinding portion is formed on the bottom of the grinding wheel at an angle from the grinding disc.

The holding cap is mounted on the top surface of the housing, encloses the grinding wheel and has a top, a front, a front hole, a disc-edge hole and a disc-top hole. The front hole is laterally defined in the front of the holding cap on an axis coinciding with the front grinding portion of the grinding wheel. The disc-edge hole is defined in the top of the holding cap on an axis coinciding with the annular edge of the grinding disc. The disc-top hole is defined in the top of the holding cap on an axis coinciding with the top of the grinding disc.

The brackets are mounted in a corresponding hole and have a working hole and at least one pair of holding block. Each working hole is defined through the bracket and aligns with the corresponding axis of the holding cap. Each pair of holding blocks are formed on and protrude from the bracket adjacent to the working hole and have a height. The heights of the holding blocks of the brackets mounted in the disc-top and disc-edge holes are smaller than the heights of the holding blocks of the bracket mounted in the front hole. The clamping assembly is selectively inserted into one of the front, disc-edge and disc-top brackets to hold a milling cutter and is therefore pre-aligned at the correct angle required for grinding the milling cutter. Therefore the cutter grinding device of the present invention requires little training for use and may be used easily, quickly and conveniently, therefore reducing costs.

Other objects, advantages and novel features of the invention will become more apparent from the following detailed description when taken in conjunction with the accompanying drawings.

DETAILED DESCRIPTION OF PREFERRED EMBODIMENT

Figure 1:
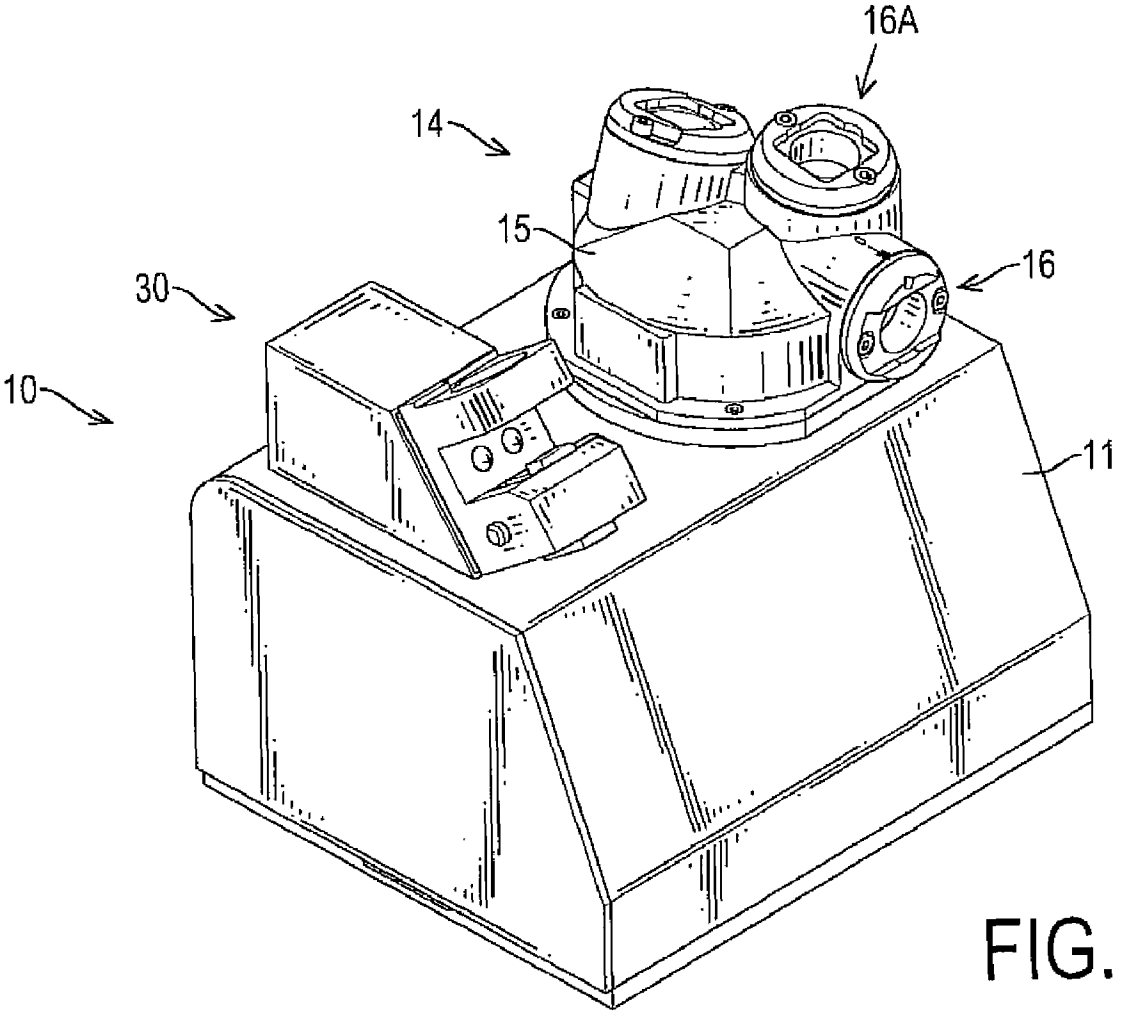
FIG. 1 is a perspective view of a cutter grinding device in accordance with the present invention.
Figure 2:
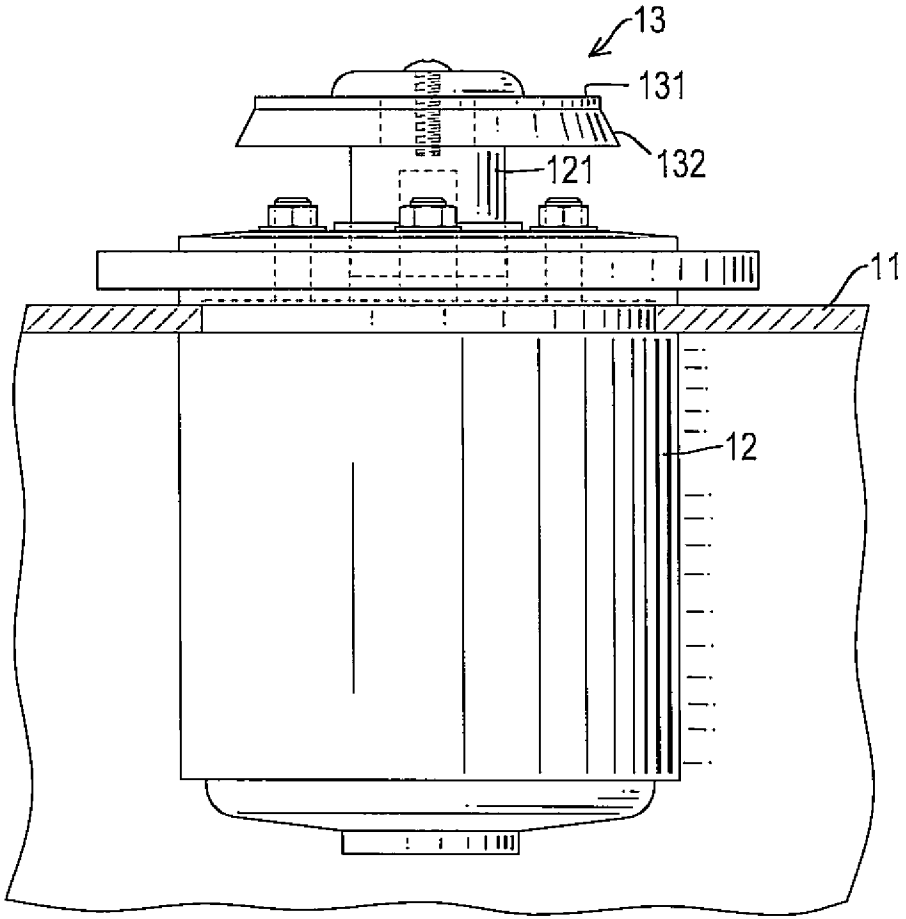
FIG. 2 is an enlarged side view in partial section of a motor and grinding wheel of the cutter grinding device in FIG. 1.
Figure 7:
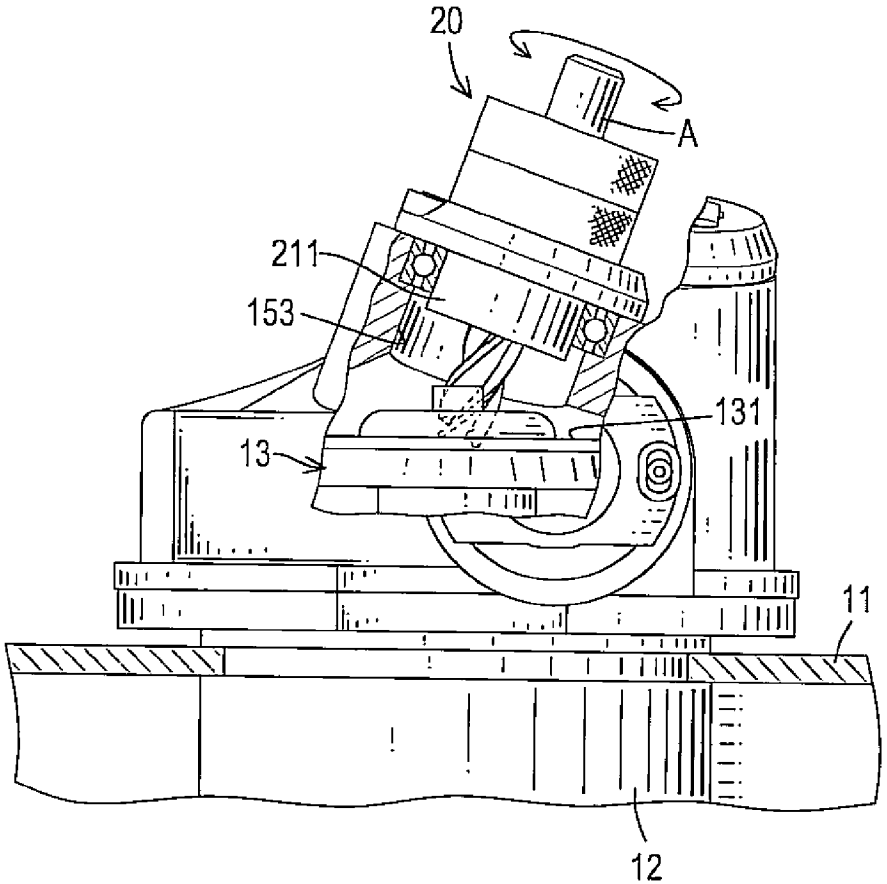
FIG. 7 is an operational side view in partial section of the cutter grinding device in FIG. 1, showing the cutter mounted in the clamping assembly, inserted in the disc-top hole and being ground.

With reference to FIGS. 1, 2 and 7, a cutter grinding device (10) in accordance with the present invention comprises a housing (11), a motor (12), a grinding wheel (13), a holding cap (15), multiple brackets (16), a clamping assembly (20) and an auxiliary positioning device (30).

The housing (11) is hollow and has a top surface.

The motor (12) is mounted in the housing (11) and has a drive shaft (121) protruding out from the top surface of the housing (11).

The grinding wheel (13) is attached to and driven by the drive shaft (121) and has a grinding disc (131) and a front grinding portion (132). The grinding disc (131) has a top and an edge. The front grinding portion (132) is formed from the grinding wheel (13) at an angle from the edge of the grinding disc (131).

With further reference to FIGS. 3 to 7, the holding cap (15) is attached to the top surface of the housing (11), encloses the grinding wheel (13) and has a top, a front, a front hole (151), a disc-edge hole (152) and a disc-top hole (153).

The front hole (151) is laterally defined in the front of the holding cap (15) on a front axis coinciding with the front grinding portion (132) of the grinding wheel (13). The disc-edge hole (152) is defined in the top of the holding cap (15) on a disc-edge axis coinciding with the edge of the grinding disc (131). The disc-top hole (153) is defined in the top of the holding cap (15) on a disc-top axis coinciding with the top of the grinding disc (131).

The brackets (16) are mounted respectively in the holes (151,152,153) in the holding cap (15).

Figure 4:
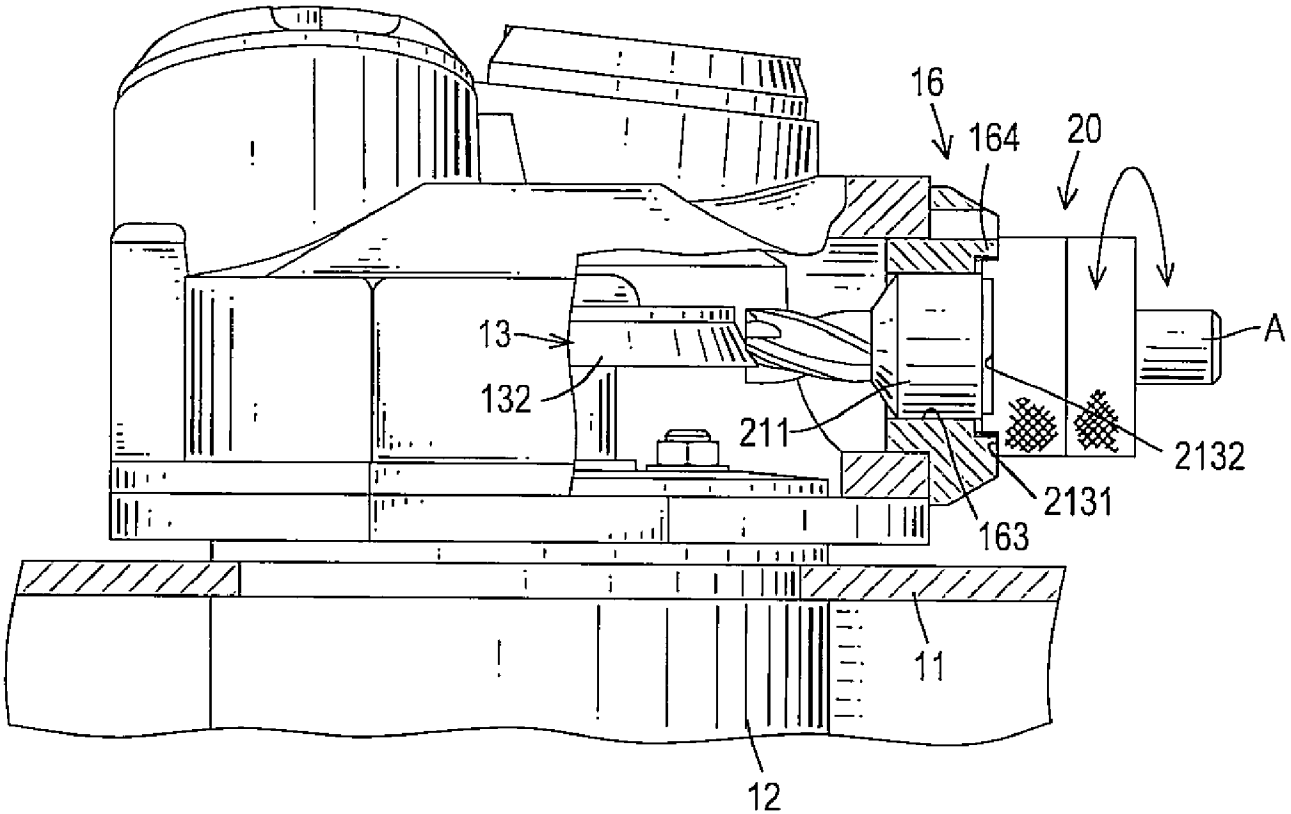
FIG. 4 is an operational side view in partial section of the cutter grinding device in FIG. 1, showing a cutter mounted in a clamping assembly, inserted in the front hole and being ground.
Figure 5:
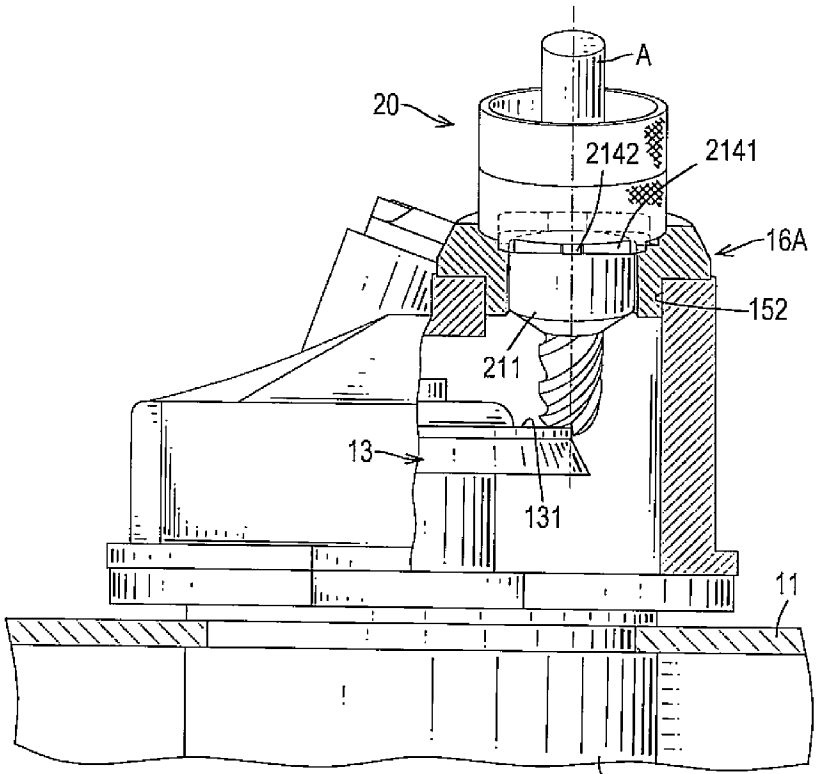
FIG. 5 is an operational side view in partial section of the cutter grinding device in FIG. 1, showing a cutter mounted in the clamping assembly, inserted in the disc-edge hole and being ground.
Figure 6:
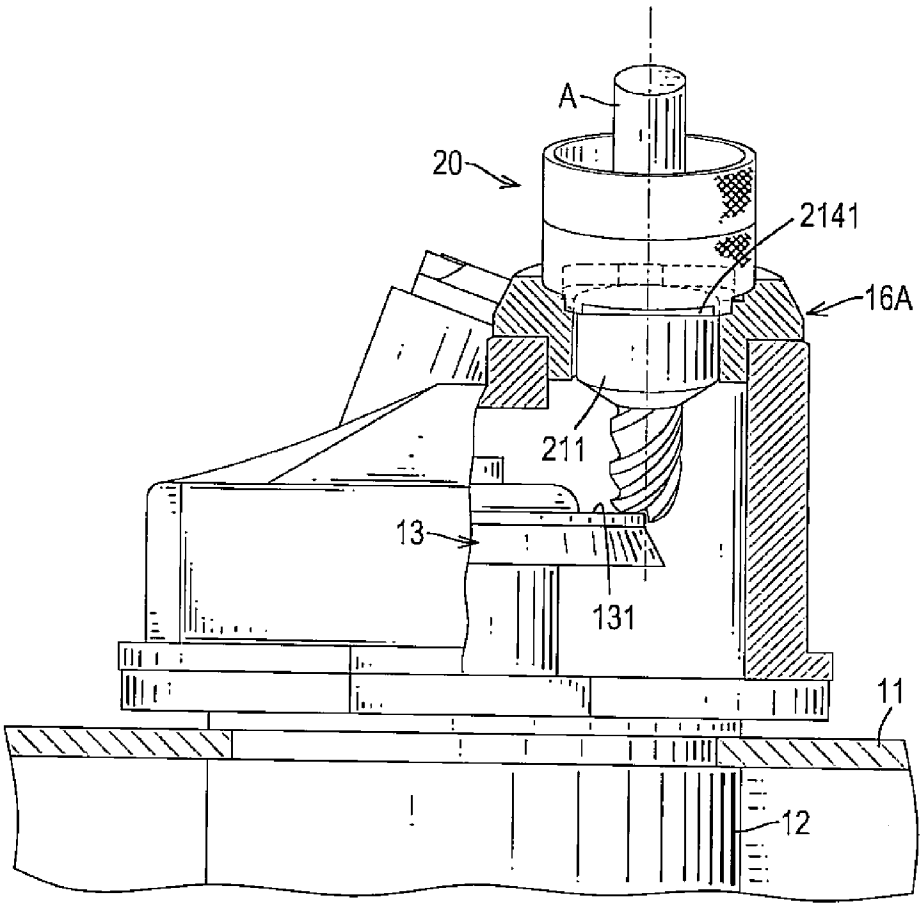
FIG. 6 is an operational side view in partial section of the knife grinding device in FIG. 1, showing that the cutter mounted in the clamping at different angle and is ground.

With further reference to FIG. 4, each bracket (16, 16A) is mounted in, may be mounted securely, may be mounted adjustably in the corresponding hole (151, 152, 153) in the holding cap (15) and has an outer surface, a working hole (163), at least one pair of holding blocks (164), two optional curved through holes (161) and two optional bolts (162).

The working hole (163) is defined axially through the bracket (16, 16A) and aligns with the corresponding hole (151, 152, 153) in the holding cap (15).

Each pair of holding blocks (164) are formed oppositely on and protrude in pairs from the outer surface of the bracket (16, 16A) and each has an engaging side (1641), a height and may comprise an engaging notch (1642). The engaging sides of each pair of holding blocks (164) face one another. Each engaging notch (1642) is formed in the engaging side (1641).

The curved through holes (161) are defined adjacent to the working hole (163) and preferably have an arc length of 30°.

The bolts (162) are mounted respectively through the curved through holes (161) in the corresponding bracket (16, 16A) and mounted in the holding cap (15) adjacent to the corresponding hole (151, 152, 153). Therefore, the bracket (16, 16A) may pivot 30° from the corresponding axis of the corresponding hole (151, 152, 153) of the holding cap (15).

In a first embodiment the bracket (16) comprises one pair of holding blocks (164) and is preferably mounted over the front hole (151).

In a second embodiment the bracket (16A) comprises two pairs of holding blocks (164) formed perpendicular to each other and the height of the holding blocks is less than the first embodiment and is mounted over the disc-edge and disc-top holes (152, 153).

Figure 3:
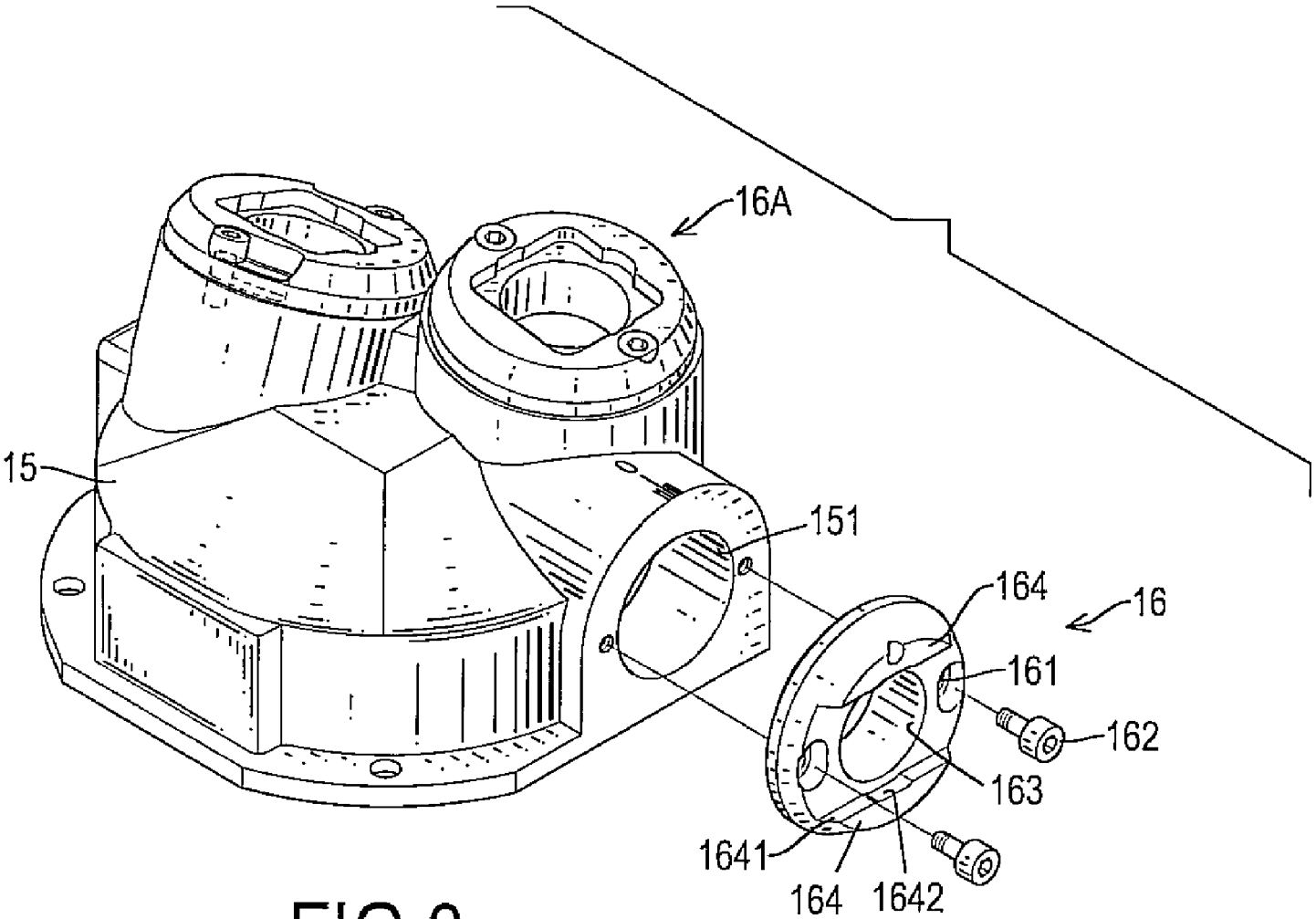
FIG. 3 is a perspective view of a holding cap of the cutter grinding device in FIG. 1, wherein a cutter holding bracket is shown exploded.
Figure 8:
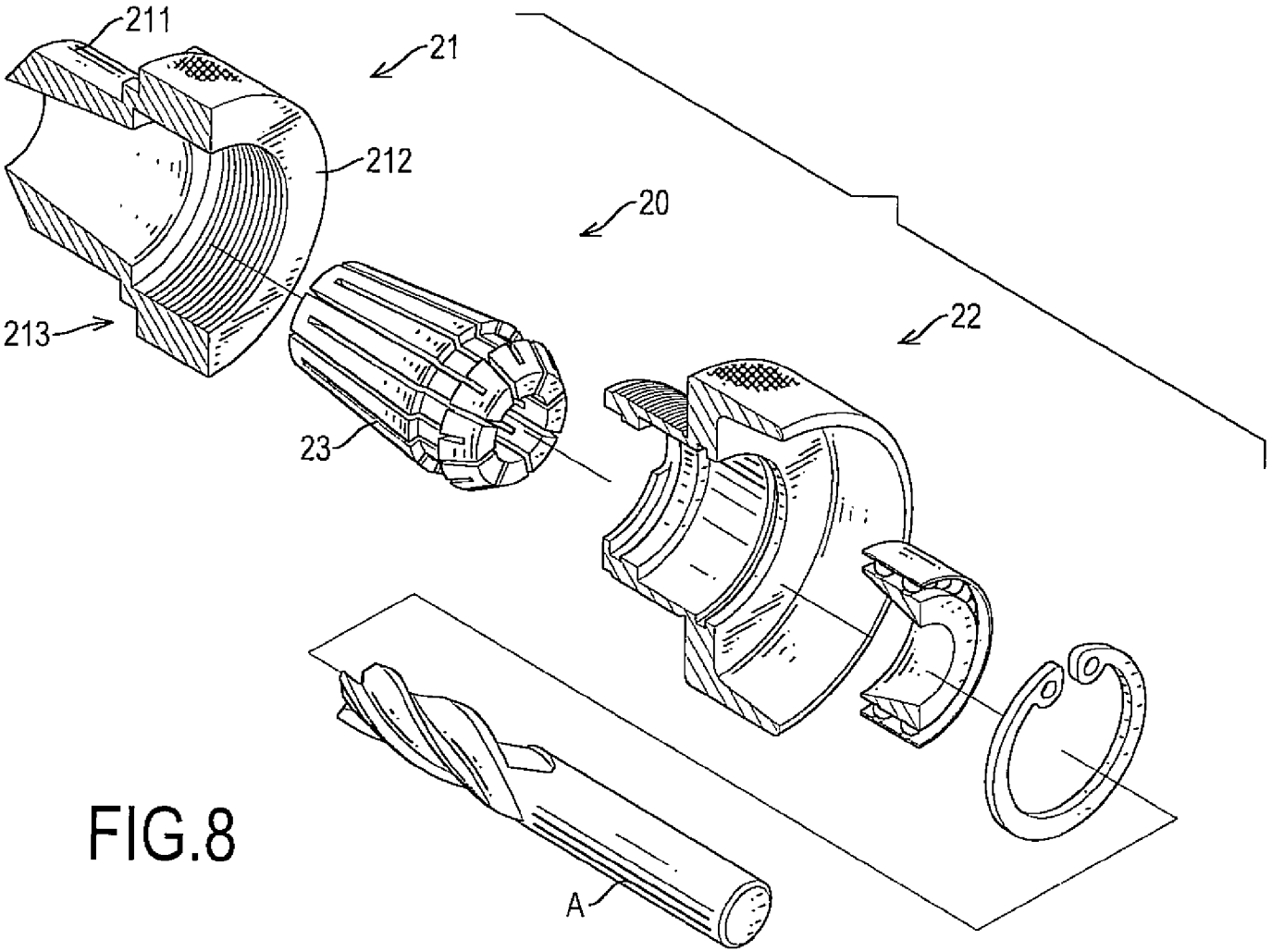
FIG. 8 is an exploded perspective view of a cutter mounted in the clamping assembly in FIG. 4.
Figure 9:
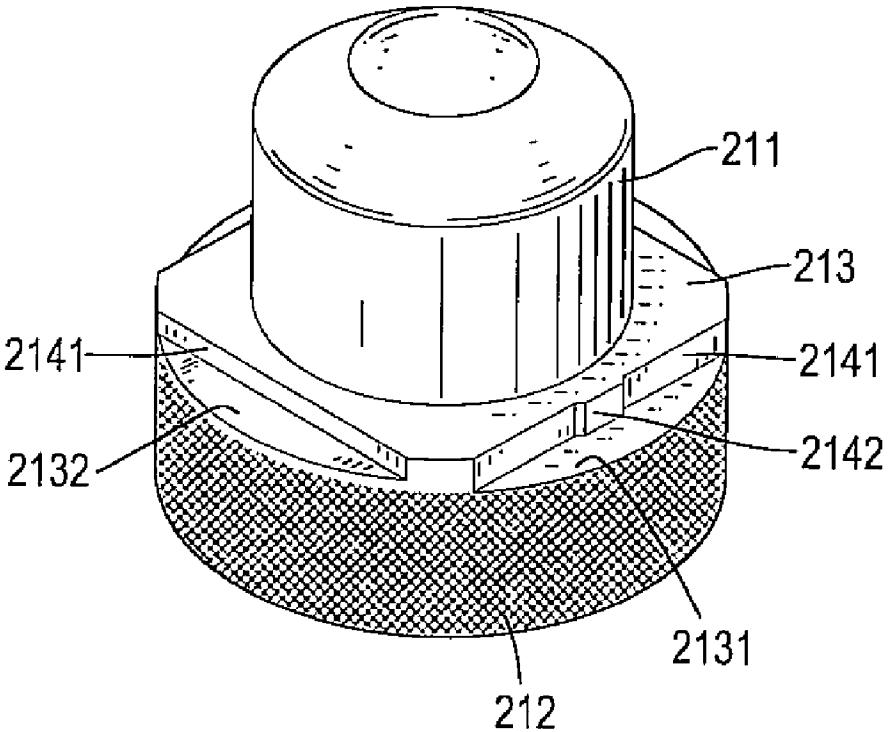
FIG. 9 is a perspective view of an outer sleeve of the clamping assembly in FIG. 8.

With further reference to FIGS. 3, 8 and 9, the clamping assembly (20) is selectively mounted into one of the brackets (16, 16A), holds a milling cutter (A) and comprises an outer sleeve (21), a core (23), a clamping base (22) and a bearing.

The outer sleeve (21, 21A) comprises an inserting end, a clamping end (212), an inserting tube (211), a shoulder (213, 213A) and multiple holding surfaces (2131, 2131A, 2131B, 2132, 2132A, 2132B).

The clamping end (212) has an inner thread formed therein.

The inserting tube (211) is formed on the inserting end, is selectively inserted into the brackets (16, 16A) and has a through hole formed through the inserting tube (211). The through hole of the outer sleeve (21, 21A) may be conical. The shoulder (213, 213A) is formed adjacent to the inserting end at the clamping end (212) and has an annular edge.

The holding surfaces (2131, 2131A, 2131B, 2132, 2132A, 2132B) are defined around the annular edge of the shoulder (213, 213A) and correspond respectively to fins of the milling cutter (A). Each holding surface (2131, 2131A, 2131B, 2132, 2132A, 2132B) has a side wall (2141) and a depth. The depth may be less than the height of the holding blocks (164) of the first embodiment of the bracket (16) and larger than the height of the holding blocks (164) of the second embodiment of the bracket (16A).

In a first embodiment of the outer sleeve (21), as shown in FIG. 9, the depths of the holding surfaces (2131, 2132) may be different, and the outer sleeve (21) has four holding surfaces (2131,2132) comprising two parallel deep holding surfaces (2131) and two parallel shallow holding surfaces (2132) alternatively arranged perpendicular to each other. The side wall (2141) of each deep holding surface (2131) has an engaging block (2142) formed on and protruding from the side wall (2141) and selectively engaging one of the engaging notches (1642) in the corresponding holding block (16, 16A). The outer sleeve (21) with four holding surfaces (2131, 2132) can be implemented with a milling cutter (A) having four fins.

Figure 10:
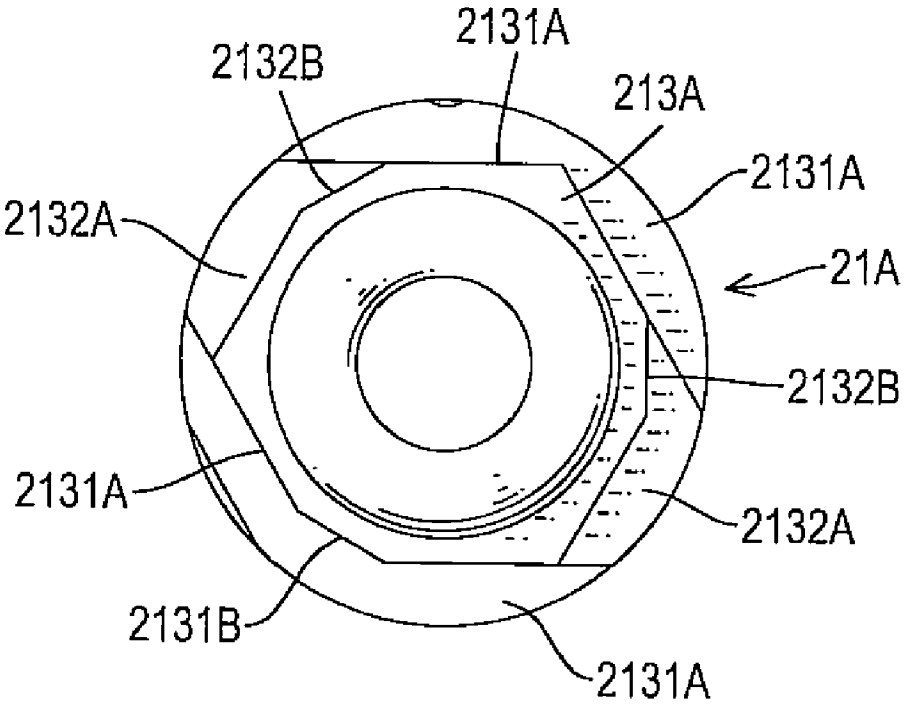
FIG. 10 is a side view of an embodiment of an outer sleeve in accordance with the present invention.
Figure 11:
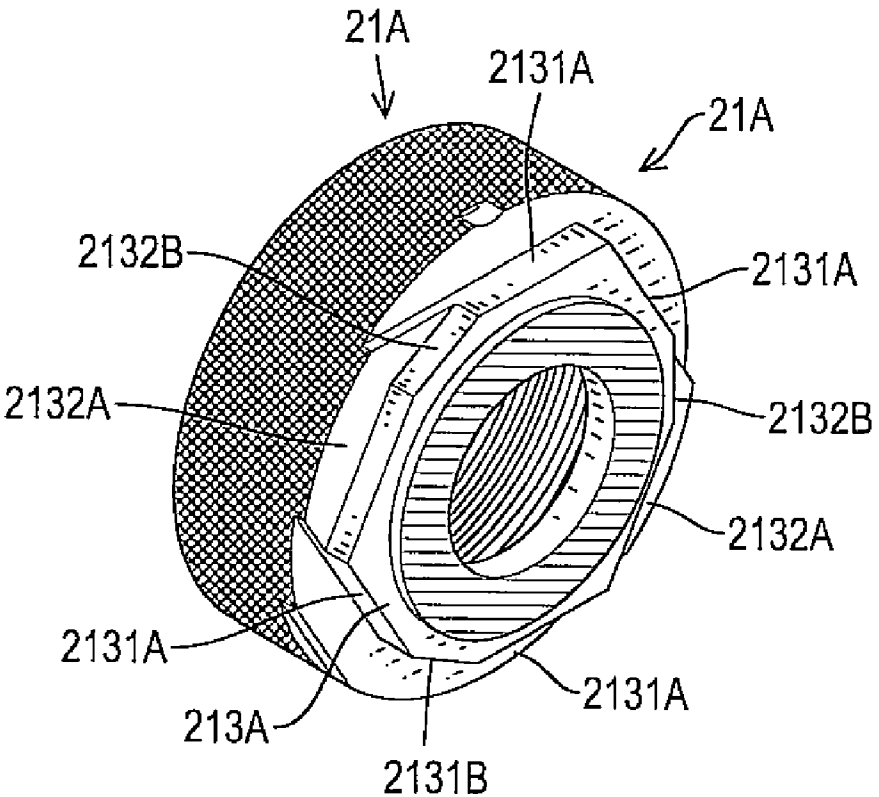
FIG. 11 is a perspective view in partial section of the outer sleeve in FIG. 9.

In second embodiment of the outer sleeve (21A), as shown in FIGS. 10 and 11, the outer sleeve comprises nine holding surfaces (2131A, 2131B, 2132A, 2132B) defined around the annular edge of the shoulder (213A) and comprises four rhombic deep holding surfaces (2131A), two parallel shallow holding surfaces (2132A) and three triangular holding surfaces (2131B, 2132B), wherein one triangular holding surface is a deep triangular holding surface (2131B) and two triangular holding surfaces are shallow triangular holding surfaces (2132B).

The four rhombic deep holding surfaces (2131A) comprise two pairs of parallel deep surfaces that intersect at an apex on a diameter of the shoulder (213A). The apex has an included angle of 120°.

The two parallel shallow holding surfaces (2132A) intersect the parallel deep surfaces at an inflexion having an included angle of 120°, thereby forming a regular hexagon.

The triangular holding surfaces (2131B, 2132B) form an equilateral triangle. The deep triangular holding surface (2131A) intersects two different parallel deep surfaces adjacent to the apex. The two shallow triangular holding surfaces intersect one shallow parallel surface (2132A) and one deep parallel surface adjacent to the inflection.

The second embodiment of the outer sleeve (21A) can be implemented with a milling cutter having three or six flutes.

The inner clamping core (23) is mounted inside the outer sleeve (21) and is conical, may correspond to the conical through hole in the inserting tube (211), is resilient and compressible to clamp the milling cutter (A). The inner clamping core (23) has a clamping hole defined longitudinally through the inner clamping core (23) and multiple slits defined longitudinally in the inner clamping core (23) and communicating with the clamping hole to make the core (23) resilient and compressible.

The clamping base (22) is attached rotatably to the clamping end (212) of the outer sleeve (21) and engages the inner clamping core (23) and presses the inner clamping core (23) against the outer sleeve (21) when the clamping base (22) is rotated. The clamping base (22) has an outer thread that engages the inner thread of the outer sleeve (21).

The bearing is mounted in the clamping base (22) and around one end of the inner clamping core (23), abuts and allows the inner clamping core (23) to freely rotate relative to the clamping base (22).

Figure 12:
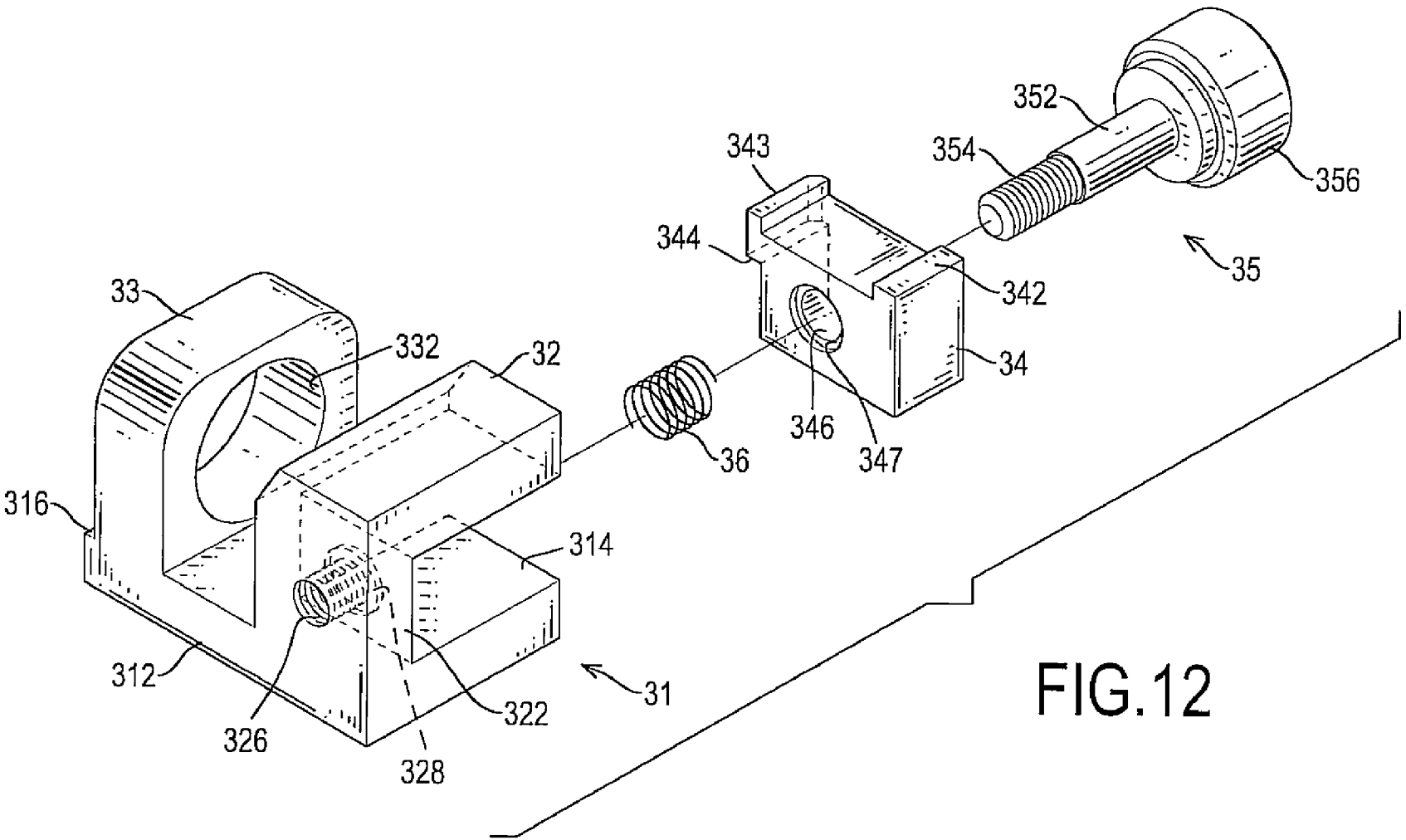
FIG. 12 is an exploded perspective view of the auxiliary positioning device of the cutter grinding device in FIG. 1.

With further reference to FIG. 12, the auxiliary positioning device (30) is mounted on the top surface of the housing (11) and comprises a base (31), a slider (34), an adjusting bolt (35) and a spring (36).

The base (31) is U-shaped, is attached securely to the top surface of the housing (11) and comprises a bottom plate (312), an adjusting rail (32) and a positioning mount (33). The bottom plate (312) has a top, a positioning edge, a positioning ridge (316) and an adjustment edge.

The adjusting rail (32) is formed on and protrudes from the top at the adjustment edge of the bottom plate (312) and has a slot (314) and a spacer (322). The slot (314) is defined in the rail perpendicular to the adjusting rail (32). The spacer (322) is formed adjacent to the slot (314) and has an inner surface, a threaded hole (326) and a rim (328). The threaded hole (326) is formed in the inner side of the spacer (322). The rim (328) is formed concentrically with, defined around and communicates with the threaded hole (326).

The positioning mount (33) is formed on and protrudes from the top near the positioning edge of the bottom plate (312) to define the positioning ridge (316) between the positioning mount (33) and the positioning edge of the bottom plate (312). The positioning mount (33) has a positioning hole (332) defined through the positioning mount (33) and corresponding to the slot (314) of the rail (32).

The slider (34) is mounted slidably in the slot (314) in the base (31) and comprises a top, a positioning side, an adjusting side, a front positioning rib (342), a rear positioning rib (343) and an adjusting hole (346).

The front positioning rib (342) is formed on and protrudes from the top at the adjusting side of the slider (34) and has an outer side being flush with the adjusting side of the slider (34).

The rear positioning rib (343) is formed on the positioning side of the slider (34) and has an inner side being flush with the corresponding side of the slider (34) and an outer side protruding from the slider (34) to define an abutting bottom (344).

The adjusting hole (346), facing the base (31), is defined through the slider (34) and has a rim (347) defined around the adjusting hole (346).

The adjusting bolt (35) extends through the adjusting hole (346) in the slider (34) and has a threaded shank (352) and a head (356) and is. The threaded shank (352) is mounted in the threaded hole (326) in the spacer (322) of the rail (32). The head (356) is formed on the shank (352).

The spring (36) is mounted around the shank (352) of the adjusting bolt (35) in the rims (328, 347) of the rail (32) and the slider (34).

Figure 13:
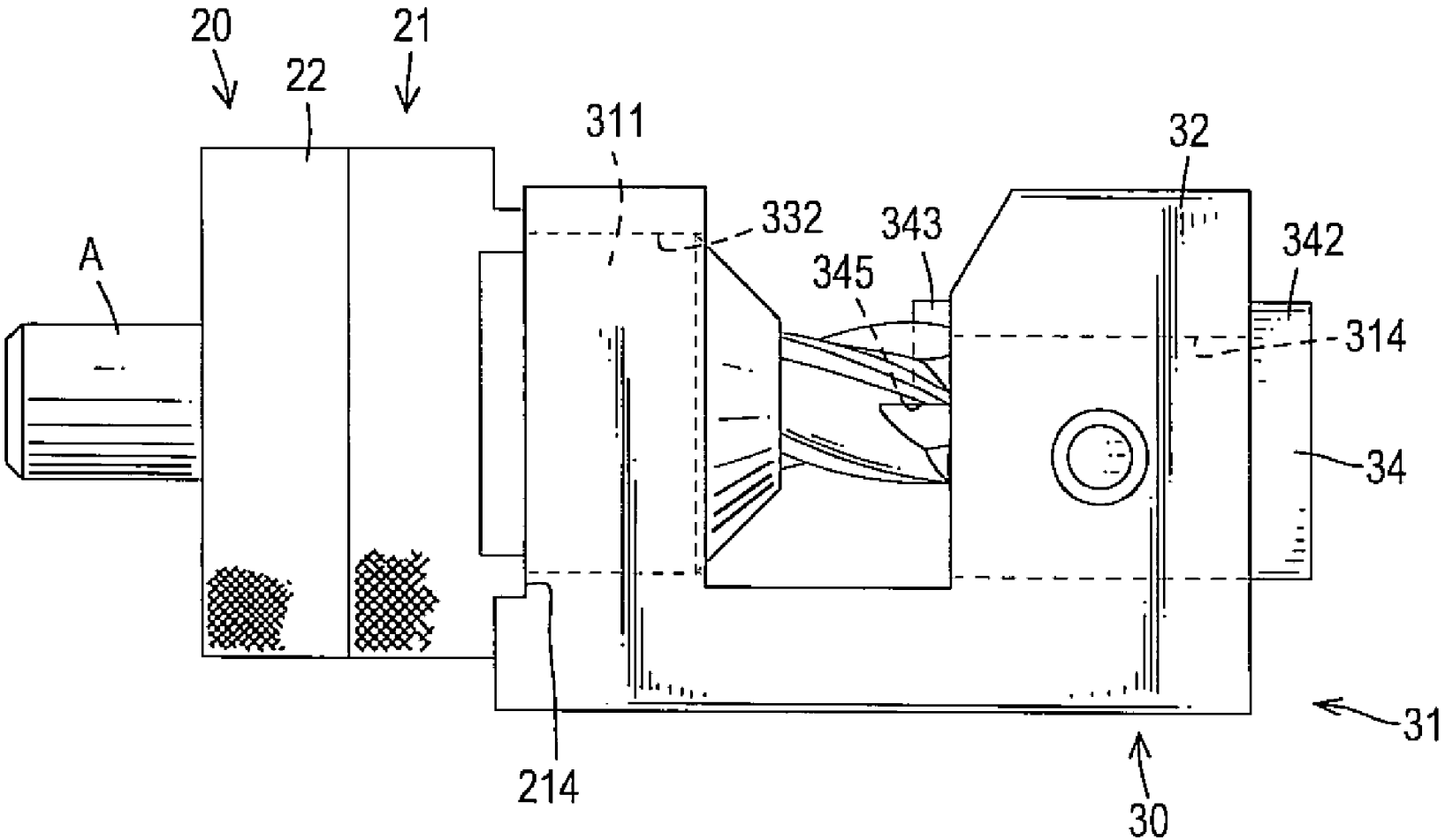
FIG. 13 is an operational side view of the auxiliary positioning device in FIG. 12, shown implemented with the cutter clamping assembly.

With further reference to FIG. 13, after a milling cutter (A) is inserted into the clamping hole in the inner clamping core (23) and protrudes out from the inserting tube (211) of the outer sleeve (21), the inserting tube (211) of the outer sleeve (21) is inserted into the positioning hole (332) in the positioning mount (33). When the inserting tube (211) is inserted into the positioning hole (332), the shoulder (213) of the outer sleeve (21) abuts the positioning mount (23) and the positioning ridge (316) is held in one of the holding surfaces (2131, 2132, 2131A, 2132A, 2131B, 2132B) to hold the cutter clamping assembly (20) in place. The adjusting bolt (35) is then rotated, to move the slider (34) relative to the base (21) along the channel (314) to a position where the abutting bottom (344) of the rear rib (342) on the slider (34) aligns with the fins of the cutter (A). Then, the cutter (A) is rotated to make one of the tips abut the abutting bottom (344) of the rear rib (343) on the slider (34). Finally, the clamping base (22) is rotated to securely engage the outer sleeve (21), such that the inner clamping core (23) is moved and compressed by the conical through hole in the inserting tube (211) and the milling cutter (A) is held in a desired position in the clamping assembly (20).

The clamping assembly (20) with the cutter (A) is removed from the positioning device (30) and inserted into one of the holes (151,152,153) in the holding cap (15) through the corresponding bracket (16, 16A). Different parts of the fins or flutes of the cutter (A) are ground by the top or annular edge of the grinding disc (131) or the front grinding portion (132) of the grinding wheel (13) at different desired angles. When the cutter clamping assembly (20) is inserted into the corresponding hole (151,152,153), the bottoms of the holding surfaces (2131,2132, 2131A, 2132A, 2132B, 2132B) abut with the holding blocks (164) of the corresponding holding bracket (16, 16A) thereby holding the fins of the cutter (A) at desired positions and ground by the corresponding grinding portions (131,132) on the grinding wheel (13) and sharpen the cutter (A) is easily and conveniently.

Additionally, different heights of the holding blocks (164) and depths of the holding surfaces (2131, 2132, 2131A, 2132A, 2131B, 2132B), allow the fins of the cutter (A) to be held at different positions relative the grinding wheel (13). Consequently, the tips of the cutter (A) can be ground at different depths.

When the clamping assembly (20) with the cutter (A) is inserted into the bracket (16) on the front hole (151) and deep holding surfaces (2131, 2131A, 2131B) in the outer sleeve (21, 21A) engage the holding blocks (164) on the bracket (16), the engaging blocks (2142) on the outer sleeve (21) engage respectively with the engaging notches (1642) in the holding blocks (164). When the cutter clamping assembly (20) is removed from the hole (151), rotated and reinserted into the front hole (151), the shallow holding surfaces (2132, 2132A, 2132B) engage the holding blocks (164) on the front holding bracket (16). Because the deep holding surfaces (2131) are deeper than the shallow holding surfaces (2132), the fins on the cutter (A) can be ground at different angles.

Furthermore, because the brackets (16, 16A) mounted on the front and the disc-top holes (151, 152) are adjustably mounted on the holding cap (15), the brackets (16,16A) can pivot relative to the holding cap (15) along the curved through holes (161) thereby changing an angle of grounding to allow the miller cutter to be used for heavy load cutting/milling processes.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cutter grinding device comprising:

a housing having a top surface;

a motor being mounted in the housing and having a drive shaft protruding out from the top surface of the housing;

a grinding wheel being attached to and driven by the drive shaft and having a grinding disc having a top and an edge; and a front grinding portion being formed from the grinding wheel at an angle from the edge of the grinding disc;

a holding cap being attached to the top surface of the housing, enclosing the grinding wheel and having a top;

a front;

a front hole being laterally defined in the front of the holding cap on a front axis coinciding with the front grinding portion of the grinding wheel;

a disc-edge hole being defined in the top of the holding cap on a disc-edge axis coinciding with the edge of the grinding disc; and a disc-top hole being defined in the top of the holding cap on a disc-top axis coinciding with the top of the grinding disc;

multiple brackets being mounted respectively in the front, disc-top and disc edge holes in the holding cap and each bracket having an outer surface;

a working hole being defined axially through the bracket and aligning with the corresponding hole in the holding cap; and at least one pair of holding blocks being formed on and protruding in pairs from the outer surface of the bracket and each having an engaging side and a height, wherein the engaging sides of each pair face one another; and the height of the holding blocks of the bracket mounted in the front hole is larger than the height of the holding blocks on the brackets mounted in the disc-top and disc-edge holes; and a clamping assembly being selectively mounted into one of the brackets for holding a milling cutter.

2. The cutter grinding device as claimed in claim 1, wherein the clamping assembly comprises an outer sleeve having an inserting end;

a clamping end;

an inserting tube being formed on the inserting end and having a through hole formed therethrough;

a shoulder being formed adjacent to the inserting end at the clamping end and having an annular edge; and multiple holding surfaces being defined around the annular edge of the shoulder and each having a depth smaller than the height of the holding blocks of the bracket mounted in the front hole and larger than the heights of the holding blocks of the brackets mounted in the disc-edge and disc-top holes;

a core being mounted inside the outer sleeve, being resilient and compressible to clamp the milling cutter;

a clamping base being attached rotatably to the clamping end of the outer sleeve, engaging and pressing the inner clamping core against the outer sleeve; and a bearing being mounted in the clamping base and around one end of the inner clamping core, abutting and allowing the inner clamping core to freely rotate relative to the clamping base.

3. The cutter grinding device as claimed in claim 2, wherein the clamping end of the outer sleeve further has an inner thread formed therein;

the through hole of the inserting tube further is conical;

the inner clamping core is conical, corresponds to the conical through hole in the inserting tube and has a clamping hole defined longitudinally through the inner clamping core and multiple slits defined longitudinally in the inner clamping core and communicating with the clamping hole to make the core resilient and compressible; and the clamping base further has an outer thread that engages the inner thread in the clamping end of the outer sleeve.

4. The cutter grinding device as claimed in claim 3, wherein the outer sleeve of the cutter clamping assembly comprises four holding surfaces comprising two parallel deep holding surfaces and two parallel shallow holding surfaces alternatively arranged perpendicular to one another; and each holding surface has a side wall.

5. The cutter grinding device as claimed in claim 4, wherein the bracket mounted in the front hole is mounted adjustably in the front hole and further has two curved through holes being defined adjacent to the working hole; and two bolts are mounted respectively through the curved through holes in the bracket and mounted in the holding cap.

6. The cutter grinding device as claimed in claim 5, wherein each holding block has an engaging notch defined in the engaging side; and the side wall of each deep holding surface in the outer sleeve has an engaging block formed on and protruding from the side wall and selectively engaging with one of the engaging notches in a corresponding holding block.

7. The cutter grinding device as claimed in claim 6, wherein the bracket mounted in the disc-top hole is mounted adjustably in the disc-top hole and further has two curved through holes being defined adjacent to the working hole; and two bolts are mounted respectively through the curved through holes in the bracket and mounted in the holding cap.

8. The cutter grinding device as claimed in claim 7 further comprising an auxiliary positioning device mounted on the top surface of the housing and comprising a base being U-shaped, being attached securely to the top surface of the housing and comprising a bottom plate having a top;

a positioning edge;

a positioning ridge formed adjacent to the positioning edge; and an adjustment edge;

an adjusting rail being formed on and protruding from the top at the adjustment edge of the bottom plate and having a slot being defined in the rail perpendicular to the adjusting rail; and a spacer being formed adjacent to the slot and having an inner surface and a threaded hole being formed in the inner surface having a rim being formed around the threaded hole; and a positioning mount being formed on and protruding from the top near the positioning edge of the bottom plate to define the positioning ridge between the positioning mount and the positioning edge of the bottom plate and having a positioning hole defined through the positioning mount and corresponding to the slot of the rail;

a slider mounted slidably in the slot in the base and comprising a top;

a positioning side;

an adjusting side;

a front positioning rib being formed on and protruding from the top at the adjusting side of the slider and having an outer side being flush with the adjusting side of the slider;

a rear positioning rib being formed on the positioning side of the slider and having an inner side being flush with the slider; and an outer side protruding from the slider to define an abutting bottom; and an adjusting hole facing the base, being defined through the slider and having a rim defined around the adjusting hole;

an adjusting bolt extending through the adjusting hole in the slider and having a threaded shank being mounted in the threaded hole in the spacer of the rail; and a head being formed on the shank; and a spring being mounted around the shank of the adjusting bolt and in the rims of the rail and the slider.

9. The cutter grinding device as claimed in claim 3, wherein the holding surfaces of the outer sleeve comprise nine holding surfaces defined around the annular edge of the shoulder comprising four rhombic deep holding surfaces comprising two pairs of parallel deep surfaces intersecting one another at an apex having an included angle of 120° on a diameter of the shoulder;

two parallel shallow holding surfaces intersecting the parallel deep surface at an inflection having an included angle of 120°, forming a regular hexagon;

one deep triangular holding surface intersecting two different parallel deep surfaces adjacent to the apex;

two shallow triangular holding surfaces intersecting one shallow and one deep parallel surface adjacent to the inflection and forming an equilateral triangle with the deep triangular holding surface; and each holding surface has a side wall.

10. The cutter grinding device as claimed in claim 1, wherein the bracket mounted in the front hole is mounted adjustably in the front hole and further has two curved through holes being defined adjacent to the working hole; and two bolts are mounted respectively through the curved through holes in the bracket and mounted in the holding cap.

11. The cutter grinding device as claimed in claim 1, wherein the bracket mounted in the disc-top hole is mounted adjustably in the disc-top hole and further has two curved through holes being defined adjacent to the working hole; and two bolts are mounted respectively through the curved through holes in the bracket and mounted in the holding cap.

12. The cutter grinding device as claimed in claim 1 further comprising an auxiliary positioning device mounted on the top surface of the housing and comprising a base being U-shaped, being attached securely to the top surface of the housing and comprising a bottom plate having a top;

a positioning edge;

a positioning ridge formed adjacent to the positioning edge; and an adjustment edge;

an adjusting rail being formed on and protruding from the top at the adjustment edge of the bottom plate and having a slot being defined in the rail perpendicular to the adjusting rail; and a spacer being formed adjacent to the slot and having an inner surface and a threaded hole being formed in the inner surface having a rim being formed around the threaded hole; and a positioning mount being formed on and protruding from the top near the positioning edge of the bottom plate to define the positioning ridge between the positioning mount and the positioning edge of the bottom plate and having a positioning hole defined through the positioning mount and corresponding to the slot of the rail;

a slider mounted slidably in the slot in the base and comprising a top;

a positioning side;

an adjusting side;

a front positioning rib being formed on and protruding from the top at the adjusting side of the slider and having an outer side being flush with the adjusting side of the slider;

a rear positioning rib being formed on the positioning side of the slider and having an inner side being flush with the slider; and an outer side protruding from the slider to define an abutting bottom; and an adjusting hole facing the base, being defined through the slider and having a rim defined around the adjusting hole;

an adjusting bolt extending through the adjusting hole in the slider and having a threaded shank being mounted in the threaded hole in the spacer of the rail; and a head being formed on the shank; and a spring being mounted around the shank of the adjusting bolt and in the rims of the rail and the slider.

* * * * *